US006672968B2

(12) United States Patent
Montolio

(10) Patent No.: US 6,672,968 B2
(45) Date of Patent: Jan. 6, 2004

(54) MODULAR SKATE PARK SYSTEM

(75) Inventor: Robert Montolio, Leominster, MA (US)

(73) Assignee: Compass Outdoor Products, Inc., Leominister, MA (US)

( * ) Notice: Subject to any disclaimer, the term of this patent is extended or adjusted under 35 U.S.C. 154(b) by 0 days.

(21) Appl. No.: 10/252,293

(22) Filed: Sep. 23, 2002

(65) Prior Publication Data

US 2003/0125120 A1 Jul. 3, 2003

Related U.S. Application Data

(60) Provisional application No. 60/345,671, filed on Jan. 3, 2002.

(51) Int. Cl.[7] ..... A63G 19/10
(52) U.S. Cl. ..... 472/89; 14/69.5; 472/90
(58) Field of Search ..... 472/88, 89, 90, 472/116, 136; 14/69.5, 71

(56) References Cited

U.S. PATENT DOCUMENTS

| | | | | | |
|---|---|---|---|---|---|
| 2,426,058 | A | | 8/1947 | Scogland | |
| 2,927,396 | A | * | 3/1960 | Hall, Jr. | 446/115 |
| 3,032,343 | A | | 5/1962 | Freeberg | |
| 3,634,961 | A | | 1/1972 | Nawalaniec | |
| 3,663,015 | A | | 5/1972 | Bynder et al. | |
| D246,638 | S | | 12/1977 | Hegedus | |
| 4,129,916 | A | | 12/1978 | Schlesinger et al. | |
| D257,874 | S | | 1/1981 | Sheehan et al. | |
| 4,258,911 | A | | 3/1981 | Alexander | |
| 4,285,514 | A | | 8/1981 | Romero | |
| 4,781,271 | A | | 11/1988 | Wokeck | |
| 4,807,317 | A | * | 2/1989 | Quinn et al. | 14/69.5 |
| 5,033,146 | A | | 7/1991 | Fogarty et al. | |
| 5,247,162 | A | | 9/1993 | Swartz et al. | |
| 5,267,367 | A | | 12/1993 | Wegmann, Jr. | |
| 5,289,830 | A | | 3/1994 | Levine | |
| D346,256 | S | | 4/1994 | Thomas, III et al. | |
| 5,341,533 | A | * | 8/1994 | Seitz | 14/69.5 |
| D353,930 | S | | 12/1994 | Johnson | |
| 5,446,937 | A | * | 9/1995 | Haskins | 14/69.5 |
| 5,483,715 | A | | 1/1996 | Fogarty et al. | |
| 5,524,310 | A | | 6/1996 | Farnen | |
| 5,552,768 | A | | 9/1996 | Mikiel et al. | |
| 5,586,621 | A | | 12/1996 | Moon et al. | |
| 5,599,235 | A | | 2/1997 | Lynberg | |
| 5,870,788 | A | * | 2/1999 | Witkin | 14/69.5 |
| 5,946,756 | A | | 9/1999 | Mapp | |

* cited by examiner

*Primary Examiner*—Kien T. Nguyen
(74) *Attorney, Agent, or Firm*—Brian M. Dingman, Esq.; Mirick, O'Connell, DeMallie & Lougee, LLP

(57) ABSTRACT

A modular skate park system comprising one or more platform portions, and one or more ramp members. The ramp members are connectable to the platform portions, and the platform portions can be connected to one another along their edges to accomplish an enlarged platform with one or more ramps providing access to the platform.

18 Claims, 6 Drawing Sheets

MODULAR SKATE PARK SYSTEM

CROSS REFERENCE TO RELATED APPLICATION

This application claims priority of Provisional Application Ser. No. 60/345,671, filed on Jan. 3, 2002.

FIELD OF THE INVENTION

This invention relates to a skate park system.

BACKGROUND OF THE INVENTION

Skate parks are large constructed areas with ramps, platforms, pipes, grind-rails and the like that are used typically by skateboarders, bicyclists and in-line skaters. These structures are fairly expensive to build and maintain and require supervision. Accordingly, they are somewhat uncommon, which limits their access to those who desire to learn tricks and stunts.

There are available on the marketplace several products for home use that replicate portions of skate parks. For example, molded plastic ramps such as that disclosed in U.S. Pat. No. 5,946,756 are known. These allow the user to launch from a ramp, but only provide one function of a typical skate park. Also, the ramp of this patent specifically requires that the ramp surface extend to the ground and not have a stabilizing lip where the ramp surface meets the ground. Accordingly, this ramp is not entirely stable.

SUMMARY OF THE INVENTION

It is therefore an object of this invention to provide a consumer-level modular skate park system that includes at least one or more ramp members and one or more platform portions. The ramp members can be connected to the platform portions, and the platform portions can be connected to one another to enlarge the platform. This accomplishes a modular system that can have a single ramp and a single platform, or more than one ramp and/or more than one platform.

It is a further object of this invention to provide such a system that is stable in use yet is compact to ship and display at retail, yet is easy for the consumer to assemble and use.

This invention features a modular skate park system that is designed for use by people riding bikes, in-line skaters, and skateboard riders. The system comprises one or more molded plastic ramps and one or more platform portions that are configured to be interconnected into the system. The platform portions are connectable along their edges to one or more ramp members.

In the preferred embodiment, the ramp dimensions are forty inches long by twenty-four inches wide by twelve inches high with a curved launch surface. The base of the ramp preferably defines a larger footprint than the launch surface to provide stability in use. This feature is preferably accomplished by flaring the structure out from the ramp surface, which enlarges the ground contact area, and also by providing a lip around the entire periphery of the ramp where it meets the ground, which increases the ground contact area thus stabilizing the ramp. The platform portions are preferably twenty-four inches wide by twenty-four inches long by twelve inches high and comprise an approximately 1.5 inch thick flat top portion that accepts four molded legs that interlock to form a stable support assembly for the platform. This feature allows the platform portions to be made from relatively few parts (five) and be easy to assemble yet shipped flat in a box that is only a few inches thick as opposed to over a foot thick.

One embodiment of the invention is a modular skate park system comprising one or more platform portions, one or more ramp members, and means for connecting a ramp member to a platform portion, to provide the modular skate park system. The modular skate park system may further comprise means for connecting platform portions together along their edges. The platform portions may each define an edge, and the ramp portions may define a lip for receiving an edge of a platform portion.

The ramp members may define a flared lower portion to provide an enlarged footprint. The ramp member may further define a lip around its entire periphery where it meets the ground, to stabilize the ramp member. The ramp member is preferably integrally molded. The platform portion preferably comprises an upper platform member and a lower leg assembly. The leg assembly preferably comprises a plurality of leg members adapted to be removably connected to one another and to the upper platform member. Each upper platform member is preferably integrally molded, and each leg member is preferably integrally molded.

In a more specific embodiment, the invention features a modular skate park system comprising one or more platform portions, wherein each platform portion defines an edge, and in which each platform portion comprises an integrally molded upper platform member and a lower leg assembly, wherein each leg assembly comprises a plurality of integrally molded leg members adapted to be removably connected to one another and to the upper platform member, and a plurality of integrally molded ramp members, each defining a lip for receiving an edge of a platform portion, wherein the ramp members each define a flared lower portion to provide an enlarged footprint, and wherein each ramp member further defines a lip around its entire periphery where it meets the ground, to stabilize the ramp member, and means for connecting a ramp member to a platform portion, and means for connecting platform portions together along their edges.

BRIEF DESCRIPTION OF THE DRAWINGS

Other objects, features and advantages will occur to those skilled in the art from the following description of the preferred embodiment, and the accompanying drawings, in which.

DETAILED DESCRIPTION OF THE PREFERRED EMBODIMENT OF THE INVENTION

Figure 1:
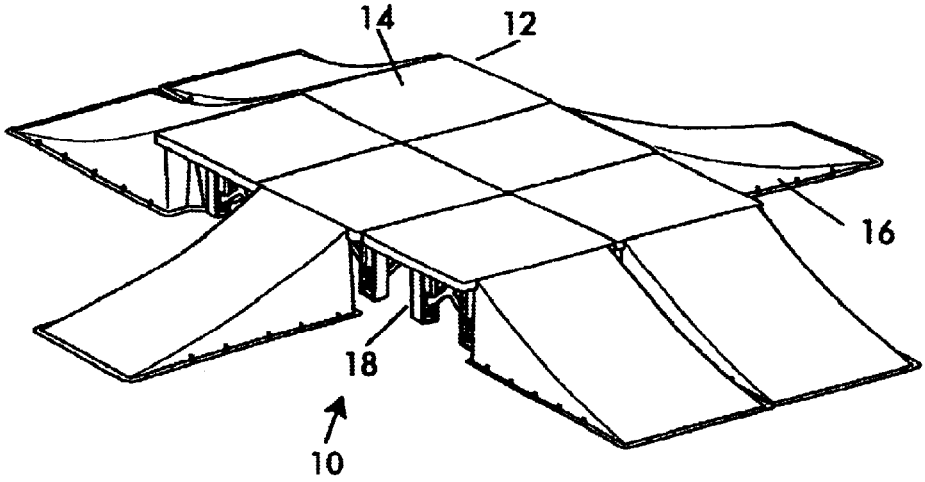
FIG. 1 is an overall view of the preferred embodiment of ramp and platforms making up the modular skate park system of this invention, in this example including six ramps and six platform portions.

The modular skate park system of this invention includes one or more ramp members and one or more platform portions. The ramps and platforms can be connected together to form a system with a desired overall configuration comprising one or more ramps and one or more platform portions. One example of a modular skate park system according to this invention is shown in FIG. 1. System 10 comprises six ramp members 16, and six platform portions 14 that in this embodiment together comprise flat tabletop surface 12.

Figure 2A:
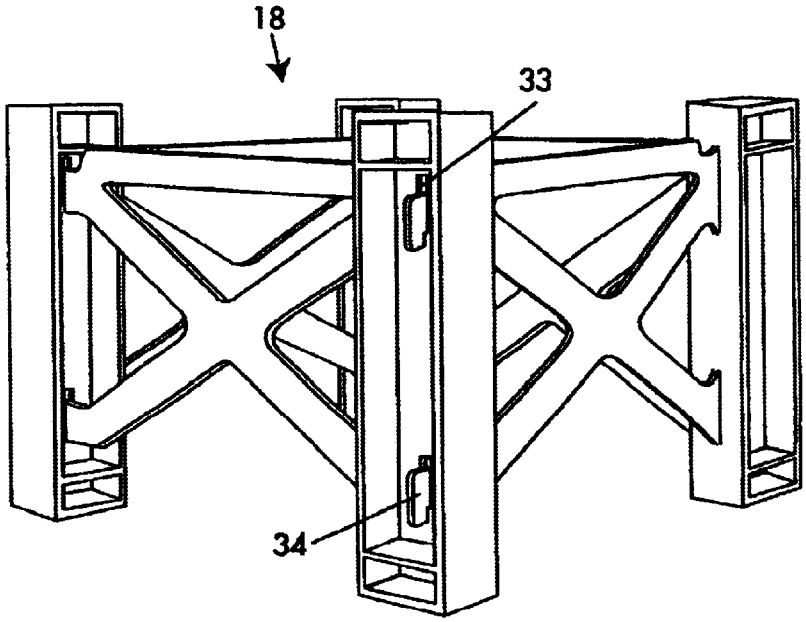
FIG. 2A shows the preferred embodiment of the assembled leg assembly for the platform portions of the invention.
Figure 2B:
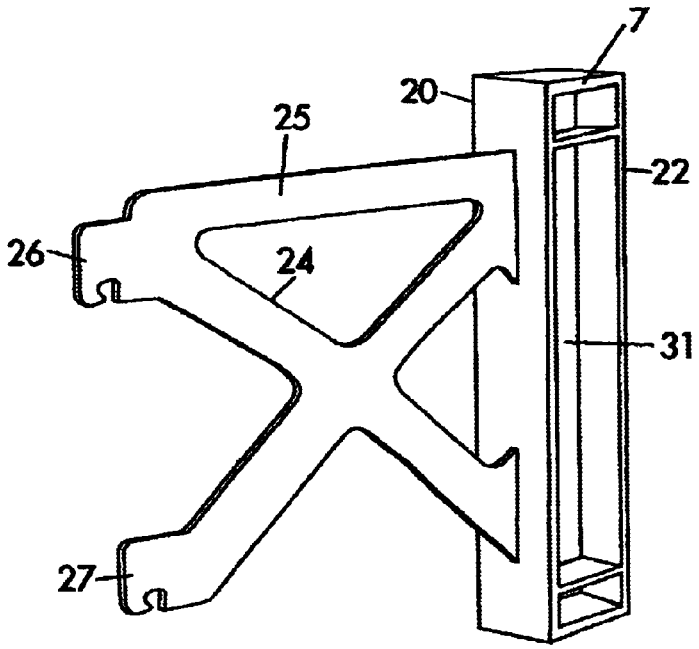
FIG. 2B shows one leg of the four-leg assembly of FIG. 2A.
Figure 2C:
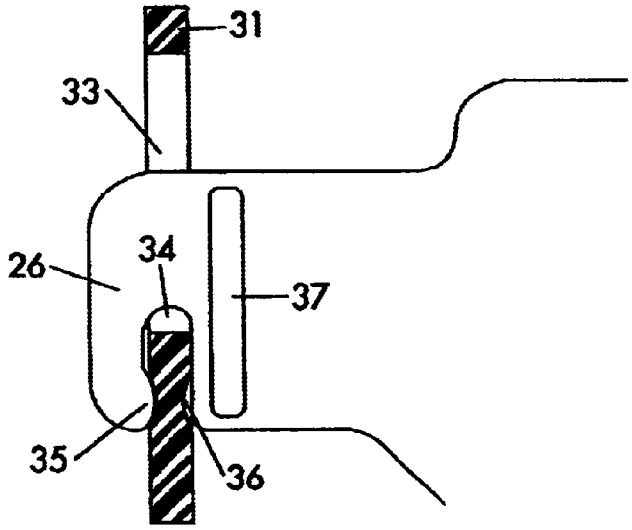
FIG. 2C depicts the preferred engagement between the legs in the leg assembly of FIG. 2A.
Figure 3:
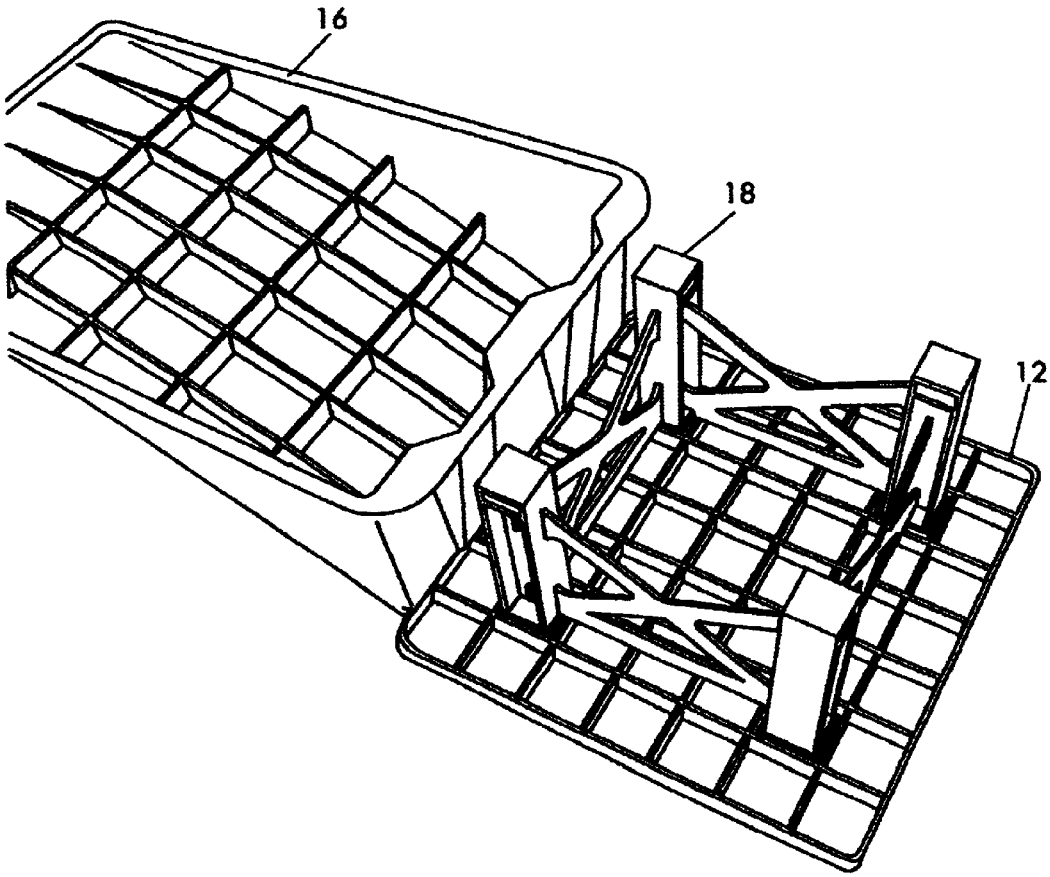
FIG. 3 is a bottom view of a fully assembled platform portion connected to a ramp.
Figure 4A:
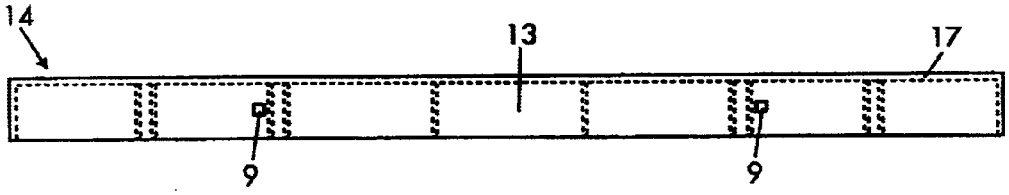
FIG. 4A is a side view of the top portion of the preferred platform portion of this invention.
Figure 4B:
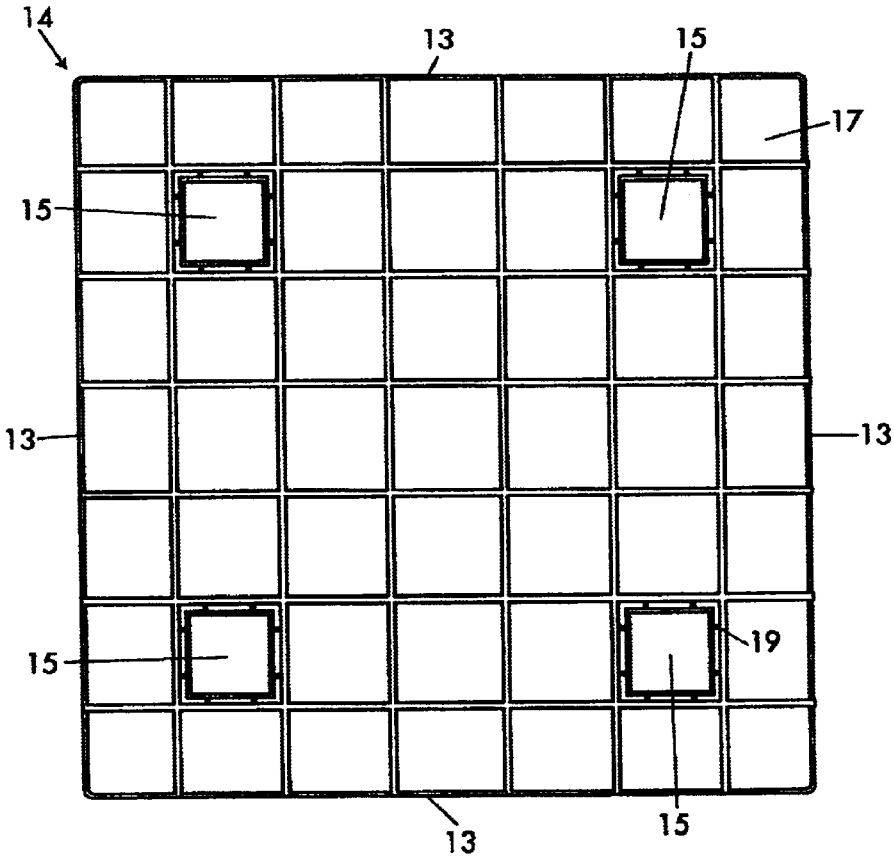
FIG. 4B is a bottom view thereof, showing the locations for accepting the tops of the four legs of the leg assembly shown in FIG. 2A.

The preferred embodiment of the platform portions is shown in more detail in FIGS. 2–4. Platform portion top member 14 is a unitary molded plastic piece preferably defining a flat top surface 24 inches by 24 inches in size, and about 1.5 inches thick. Strength and rigidity are provided by including intersecting rib arrangement 17 and side portions 13. Openings 9 are molded into sides 13 to allow member 14 to be connected to another member 14 and/or a ramp member, as is described more fully below.

Leg assembly 18, FIG. 2A, comprises four identical leg members 20 each having an upright leg portion 22, FIG. 2B, and a generally "X" shaped cross member portion 24 with an upper horizontal support 25 for added strength and lateral stability, together ending in identical hook portions 26 and 27 that are removably coupled to member 22 of an adjacent leg member through fitting in and pushing down in slots 33 and 34, respectively. As shown in FIG. 2C, end 26 defines slot 34 that fits over portion 31 of another leg. Portion 31 defines radiused area 36 into which protruding end 35 fits, to more positively hold portion 26 in portion 31. Enlarged, protruding stop 37 prevents end 26 from being inserted too far into slot 33. The removable interference fit provides rigidity and stability in use, yet allows for user-assembly of the system. The result is a stable four-legged assembly that is created from four identical parts, yet requires only a single mold, and being able to be shipped flat and easily assembled by the user. Upright leg members 22 may have tapered upper ends 7 that fit into openings 15, FIG. 4B, to provide an interference fit between leg assembly 18 and platform 14. Openings 15 are reinforced by including a number of integrally molded connecting portions or walls 19 (eight of which are preferably used, as shown in the drawing) connecting each opening 15 to the adjacent portions of strengthening grid 17.

Ramps and platforms are connected to one another in an edge-wise fashion by including mating openings 9 that can accept a carriage bolt or a like connector that rigidly connects the members together. Other mechanical connection means that allow the user to put the system together and take it apart as necessary are also contemplated herein.

Figure 5A:
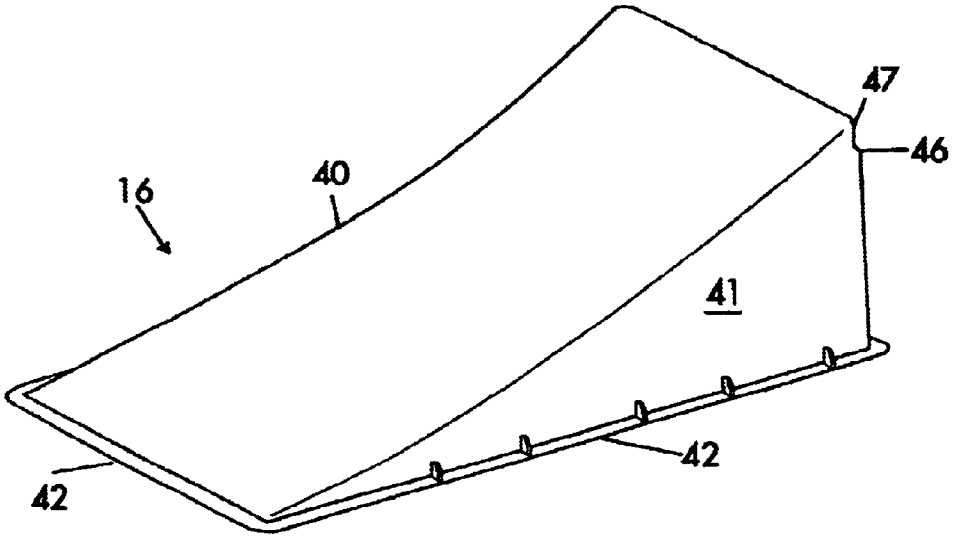
FIG. 5A is a perspective view of the preferred ramp of this invention.
Figure 5B:
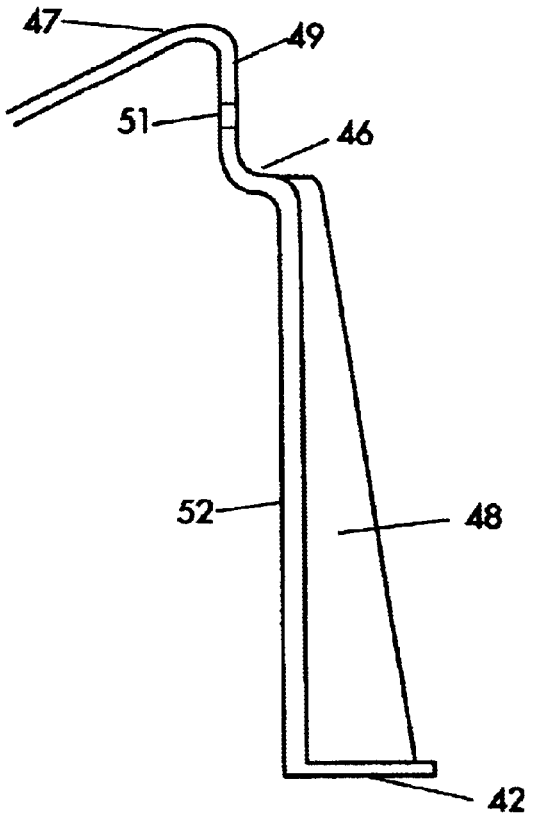
FIG. 5B is a partial more detailed view of the front portion of the ramp of FIG. 5A, detailing the manner in which a ramp holds a platform and is connected to a platform.
Figure 5C:
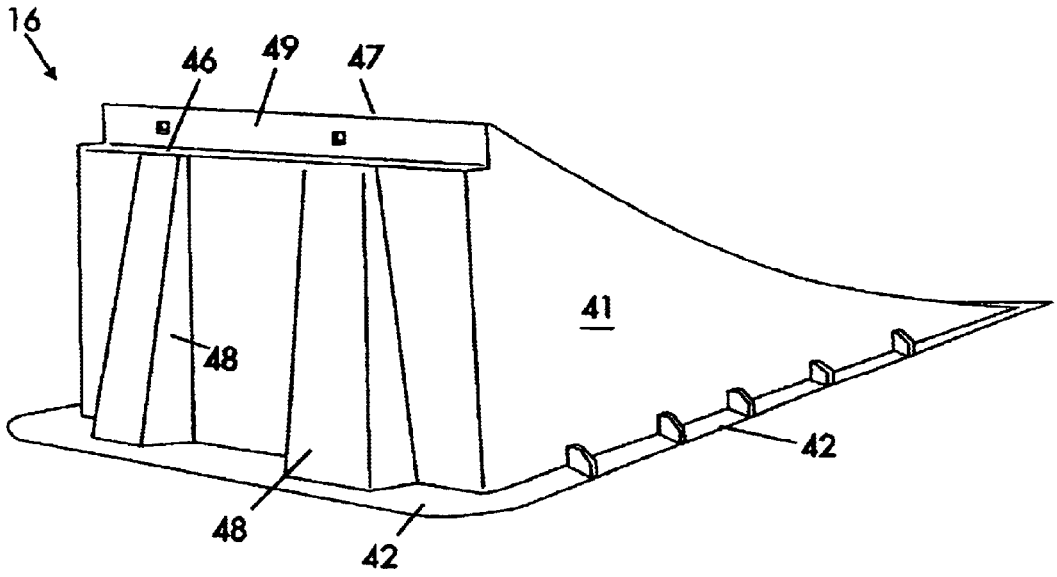
FIG. 5C is a partial view of the front of the ramp of FIG. 5A, showing the enlarged footprint and flared front portion for increased stability.

The ramp member can have any desired configuration. The preferred embodiment is shown in FIG. 5. Ramp member 16 defines curved, sloped top ramp surface 40 that ends at point 47. Sides 41 support top surface 40. The front (in other words, the highest portion) is preferably flared out so that its footprint where it meets the ground is larger than the ramp surface. In conjunction with a horizontal, ground-level lip 42 that lies along the lower periphery and thus against the ground, this defines an overall footprint that is larger than the ramp surface, to provide additional stability in use, both in terms of sliding along the ground, and flattening out when weight is applied to the ramp surface 40. Flared front pedestal portions 48 provide additional strength and stability to the ramp.

Front wall 49 defines horizontal lip 46 on which the edge of a platform portion sits. Opening 51 is aligned with opening 9 in the side of a platform portion, to allow a carriage bolt to pass through both the ramp and platform portions.

The drawings and description are not a limitation of the invention, but are meant only to depict the preferred embodiment thereof. The invention is set forth in the following claims.

What is claimed is:

1. A modular skate park system comprising:

one or more platform portions, in which at least one platform portion comprises an upper platform member having a top side and an under side, and a lower leg assembly, wherein the lower leg assembly comprises a plurality of leg members, each adapted to be removably connected to the under side of the upper platform member and to be removably connected directly to at least one other leg member;

one or more ramp members; and one or more couplings for connecting a ramp member to a platform portion, to provide the modular skate park system.

2. The modular skate park system of claim 1 further comprising one or more couplings for connecting platform portions together along their edges.

3. The modular skate park system of claim 2 wherein the one or more couplings for connecting platform portions together comprises mechanical fasteners.

4. The modular skate park system of claim 3 wherein the one or more couplings for connecting platform portions together further comprises matching openings along platform edges, with which the mechanical fasteners engage.

5. The modular skate park system of claim 1 wherein the platform portions define an edge, and wherein the ramp portions define a lip for receiving an edge of a platform portion.

6. The modular skate park system of claim 1 in which at least one ramp members defines a flared lower portion to provide an enlarged footprint.

7. The modular skate park system of claim 6 wherein the flared lower portion is along the portion of the ramp that is closest to the platform portion to which it is connected.

8. The modular skate park system of claim 1 wherein the ramp members define a lip around their entire periphery where they meet the ground, to stabilize the ramp member.

9. The modular skate park system of claim 1 in which the ramp member is integrally molded.

10. The modular skate park system of claim 1 wherein the leg members are identical to one another.

11. The modular skate park system of claim 10, wherein the leg members comprise a vertical support portion.

12. The modular skate park system of claim 11 wherein the leg members further comprise a generally horizontal portion extending from the vertical support portion.

13. The modular skate park system of claim 12 wherein the horizontal portion is cantilevered and defines at its distal end one or more structures for engaging with another leg member.

14. The modular skate park system of claim 13 wherein the structures comprise hook portions that are adapted to releasably engage with the vertical support portion of another leg member.

15. The modular skate park system of claim 14 wherein each horizontal portion defines at least two hook portions.

16. The modular skate park system of claim 1 wherein each upper platform member is integrally molded and each leg member is integrally molded.

17. A modular skate park system comprising:

one or more platform portions, wherein each platform portion defines an edge, and in which each platform portion comprises an integrally molded upper platform member having an upper side and an under side, and a lower leg assembly, wherein each leg assembly comprises a plurality of integrally molded leg members adapted to be removably connected directly to one another and to the under side of the upper platform member;

a plurality of integrally molded ramp members, each defining a lip for receiving an edge of a platform portion, wherein the ramp members each define a flared lower portion to provide an enlarged footprint, and wherein each ramp member further defines a lip around its entire periphery where it meets the ground, to stabilize the ramp member;

means for connecting a ramp member to a platform portion; and means for connecting platform portions together along their edges.

18. A modular skate park system comprising:

one or more platform portions, wherein each platform portion defines an edge, and in which each platform portion comprises an integrally molded upper platform member having an upper side and an under side, and a lower leg assembly, wherein each leg assembly comprises one or more integrally molded leg members adapted to be removably connected directly to one another and to the under side of the upper platform member;

a plurality of integrally molded ramp members, each defining a lip for receiving an edge of a platform portion; and means for coupling a ramp member to a platform portion.

* * * * *